US006904873B1

(12) United States Patent
Ashton

(10) Patent No.: US 6,904,873 B1
(45) Date of Patent: Jun. 14, 2005

(54) DUAL FUEL BOILER

(75) Inventor: Larry J. Ashton, Thousand Oaks, CA (US)

(73) Assignee: Rheem Manufacturing Company, New York, NY (US)

( * ) Notice: Subject to any disclaimer, the term of this patent is extended or adjusted under 35 U.S.C. 154(b) by 0 days.

(21) Appl. No.: 10/760,622

(22) Filed: Jan. 20, 2004

(51) Int. Cl.[7] ..... F22D 5/34
(52) U.S. Cl. ..... 122/446; 431/90; 431/12
(58) Field of Search ..... 122/17.1, 17.2, 122/10, 23, 25, 446, 502; 431/89, 90, 12, 431/60–62, 278, 281; 126/116 R

(56) References Cited

U.S. PATENT DOCUMENTS 3,001,541 A * 9/1961 St Clair ..... 137/113
4,138,725 A 2/1979 Ikemoto et al.
4,359,284 A * 11/1982 Kude et al. ..... 374/37
4,559,785 A 12/1985 Gaines et al.
5,816,792 A * 10/1998 Spencer ..... 431/90
5,999,888 A 12/1999 Aubee
6,135,063 A * 10/2000 Welden ..... 122/446
6,591,817 B2 * 7/2003 Deutsch ..... 123/525
6,779,333 B2 * 8/2004 Gerhold ..... 60/39.53
2002/0096212 A1 7/2002 Yamada et al.
2003/0217555 A1 11/2003 Gerhold

* cited by examiner

*Primary Examiner*—Gregory A. Wilson
(74) *Attorney, Agent, or Firm*—Konneker & Smith, P.C.

(57) ABSTRACT

A fuel-fired boiler having a supply fan for providing essentially all of its combustion air requirements and has a non-aspirating type burner section to an inlet portion of which pressure regulator apparatus is coupled, the pressure regulator apparatus having a predetermined pressure regulation setting. Fuel delivery apparatus is coupled to the inlet of the pressure regulator apparatus and is operative to deliver thereto, from sources thereof, a selectively variable one of (1) a first fuel at a pressure greater than the pressure regulation setting, and (2) a second fuel at a pressure less than the pressure regulation setting, the second fuel having a Wobbe index greater than that of the first fuel. The design of the fuel delivery apparatus permits the burner section firing rate to remain essentially constant, without modifying the burner section, regardless of which of the two fuels is being utilized.

22 Claims, 1 Drawing Sheet

DUAL FUEL BOILER

BACKGROUND OF THE INVENTION

The present invention generally relates to combustion apparatus and, in a preferred embodiment thereof, more particularly relates to a specially designed dual fuel burner system for a fuel-fired heating appliance such as, for example, a boiler.

Dual fuel boilers have been supplied, primarily by power burner type boiler manufacturers, for many years. The ability to selectively operate a boiler, or other type of fuel-fired heating appliance, with one or the other of two different fuels (such as, for example, natural gas or propane) is desirable to provide operation if and when the primary fuel source is interrupted. Often the pricing of the primary fuel source can be discounted if the customer agrees to accept interruption of the fuel supply by the supplier when so requested. In this event, the customer simply switches to the secondary or "backup" fuel source until the source of primary fuel is re-established by the supplier.

Current power burner practices are (1) to have two separate burner heads that can be interchanged to accommodate the switch back and forth between the two different types of fuel, or (2) to have back-up fuels which essentially the same heating value and Wobbe indexes such as propane-air to back up natural gas. This conventional design, of course, requires a mechanical modification to the overall burner structure each time that a different fuel is to be used to fire the boiler. It would thus be desirable to provide a dual fuel heating appliance, such as a boiler, incorporating therein a simplified technique for switching back and forth between two alternative fuel sources. It is to this goal that the present invention is primarily directed.

SUMMARY OF THE INVENTION

In carrying out principles of the present invention, in accordance with an illustrated embodiment thereof, a fuel-fired heating appliance is provided which is representatively a dual fuel boiler and has a fuel burner with an inlet orifice. According to a key aspect of the invention, the heating appliance is provided with a specially designed fuel supply system operable to alternately supply to the inlet orifice first and second fuels having different Wobbe indexes in a manner such that the firing rate of the fuel burner remains substantially the same, without changing the inlet orifice, regardless of which one of the first and second fuels is being supplied to the fuel burner.

Representatively, the fuel burner is applied in a non-aspirating burner mode, but the invention should not be construed as being limited to this type of burner. The heating appliance further comprises a blower operative to supply combustion air to the fuel burner. The fuel supply system includes a first pressure regulator through which both of the first and second fuels must flow to reach the fuel burner, and a second pressure regulator through which only the higher Wobbe index fuel must flow to reach the fuel burner, and the pressure regulation setting of the first pressure regulator is higher than the pressure regulation setting of the second pressure regulator. Multiple fuel burners, and associated multiple first pressure regulators may be utilized in the heating appliance without departing from principles of the present invention.

In an illustrated embodiment of the fuel-fired heating appliance, a main fuel supply line structure is coupled to the orificed fuel inlet portion of the burner apparatus, and first pressure regulator apparatus is connected in the main fuel line structure and has an inlet portion. A first branch fuel supply line structure is coupled to the inlet portion of the first pressure regulator apparatus for receiving a pressurized first fuel, and a second branch fuel supply line structure is coupled to the inlet portion of the first pressure regulator apparatus for receiving a pressurized second fuel having a Wobbe index higher than that of the first fuel.

The fuel-fired heating appliance also includes valve apparatus operable to permit flow of only a selectively variable one of the first and second fuels to the inlet portion of the first pressure regulator apparatus and thus to the orificed fuel inlet portion of the fuel burner apparatus. The second pressure regulator apparatus, whose pressure regulation setting is lower than that of the first pressure regulator apparatus, is connected in the second branch fuel supply line structure. Preferably, the valve apparatus comprises a three-way switching valve to which each of the first and second branch fuel supply line structures is operatively coupled.

When the first fuel is being utilized, it is delivered to the first pressure regulator apparatus at a pressure higher than the setting of the first pressure regulator apparatus. Accordingly, the first pressure regulator apparatus reduces the pressure of the first fuel being delivered to the burner apparatus. However, when the second, higher Wobbe index fuel is being supplied to the burner apparatus, the first pressure regulator apparatus does not regulate the pressure of the second fuel downwardly (since the second fuel is delivered to the first pressure regulator apparatus at a pressure lower than its setting). Thus, the pressure of the first fuel being supplied to the burner apparatus will be a function of the setting of the first pressure regulator apparatus, while the pressure of the second fuel being supplied to the burner apparatus will be a function of the pressure of the second fuel upstream of the first pressure regulator apparatus and the pressure drop of the downstream piping and components.

DETAILED DESCRIPTION

Figure 1:
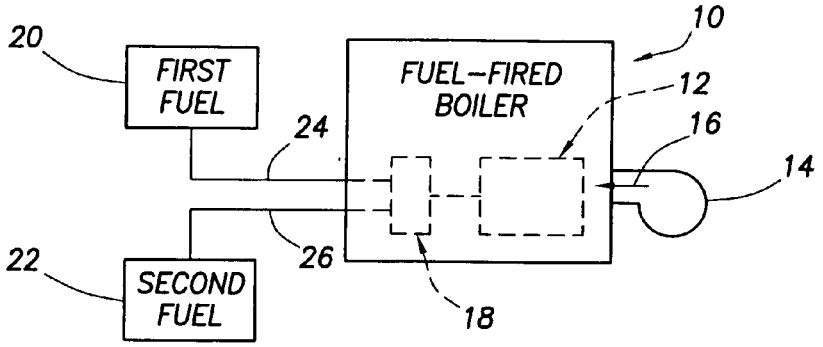
FIG. 1 is a schematic diagram of a representative dual fuel-fired boiler embodying principles of the present invention.

Schematically illustrated in FIG. 1 is a fuel-fired heating appliance which embodies principles of the present invention and is representatively a dual fuel boiler 10. While a fuel-fired boiler is representatively illustrated, the heating appliance could be a variety of other types of dual fuel heating appliances such as, for example, a pool heater or other type of fuel-fired water heater, and principles of the present invention are not limited to boiler applications.

The dual fuel boiler 10 includes fuel burner apparatus 12 which is representatively of a non-aspirating type, and a combustion air blower 14 used to supply the fuel burner apparatus 12 with combustion air 16. According to a key aspect of the present invention, the dual fuel boiler 10 is provided with a specially designed fuel supply system 18 which is operatively associated with the burner apparatus 12 and may be utilized to selectively supply to the burner apparatus 12 either a first fuel 20 (representatively natural gas) or a second fuel 22 (representatively propane) having a Wobbe index higher than that of the first fuel 20. First fuel 20 is supplied to the boiler 10 via a branch fuel supply line 24, and the second fuel 22 is supplied to the boiler 10 via a branch fuel supply line 26.

Figure 2:
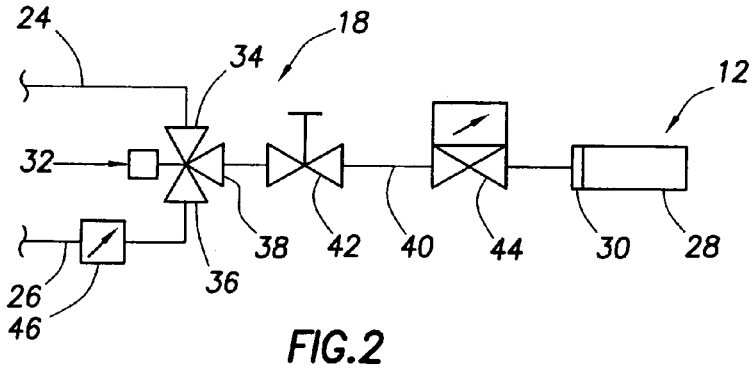
FIG. 2 is a schematic diagram of a specially designed dual fuel delivery system utilized in the boiler.

In FIG. 2 there is schematically shown a representative single burner version of the burner apparatus 12 and the fuel supply system 18. The burner apparatus 12 is a single, non-aspirating type fuel burner 28 having incorporated therein, in an inlet head portion thereof, a fuel discharge orifice 30. The fuel supply system 18 includes a three-way switching valve 32 having inlet ports 34, 36 and an outlet port 38. The first branch fuel supply line 24 is connected to the first inlet port 34, the second branch fuel supply line 26 is connected to the second inlet port 36, and a main fuel supply line 40 is interconnected between the outlet port 38 and the burner inlet fuel orifice 30. A manual shutoff valve 42 is connected in the main fuel supply line 40 downstream from the switching valve 32, and a pressure regulator apparatus 44 is connected in the fuel supply line 40 downstream from the manual shutoff valve 42. As schematically and representatively illustrated, the pressure regulator apparatus 44 is a combination pressure regulator and safety or operating valve. Alternatively, the pressure regulator apparatus 44 may comprise separate pressure regulator and valve structures operatively connected in the fuel supply line 40 downstream from the manual shutoff valve 42 without departing from principles of the present invention. A pressure regulator 46 is installed in the second branch fuel supply line 26.

By appropriately operating the switching valve 32, either the first fuel 20 or the second fuel 22 may be supplied to the burner 28 during firing thereof. According to a key feature of the present invention, when the first fuel 20 is being supplied to the burner 28 the first fuel 20 is delivered to the pressure regulator apparatus 44 at a pressure higher than its pressure regulation setting, and when the second fuel 22 is being supplied to the burner 28 the second fuel 22 is delivered to the pressure regulator apparatus 44 at a pressure lower than its pressure regulation setting. Further, the pressures of the first and second fuels 20, 22 as they reach the burner 28 are related to one another in a manner such that the firing rate of the burner 28 is essentially the same regardless of which of the fuels 20, 22 is being delivered thereto. This advantageously eliminates the necessity of changing out the burner orifice 30 each time a switch is made from either of the fuels 20, 22 to the other fuel.

Representatively, but not by way of limitation, the setting of the pressure regulator apparatus 44 is 3.5" W.C., the first fuel (by virtue of a non-illustrated upstream pressure regulator) is delivered to the switching valve 32 at a pressure within the range of from about 7" to about 14" W.C., and the pressure regulator 46 is set to reduce the pressure of the second fuel 22 delivered to the switching valve 32 to about 2.0" W.C. Accordingly, for the fuel delivery system 18 illustratively depicted in FIG. 2, when the first fuel 20 is being supplied to the burner 28 the pressure regulator apparatus 44 reduces the pressure of the first fuel 20 that it receives to 3.5" W.C. for supply to the burner 28.

However, when the second fuel 22 is being supplied to the burner 28, the pressure regulator apparatus 44 does not regulate the pressure of the second fuel downwardly (since the second fuel is delivered to the pressure regulator apparatus 44 at a pressure lower than its setting), and the second fuel 22 is supplied to the burner 28 at a pressure of about 1.3" W.C. due to the inherent valve and supply line pressure drops. Thus, the pressure of the first fuel 20 being supplied to the burner orifice 30 will be a function of the setting of the pressure regulator apparatus 44, while the pressure of the second fuel 22 being supplied to the burner orifice 30 will be a function of the pressure of the second fuel 22 upstream of the pressure regulator apparatus 44.

As can be seen, by simply adjusting the settings of the pressure regulating devices 44 and 46 the fuel delivery system 18 can be correspondingly adjusted to maintain the firing rate of the burner 28 at a substantially constant level when other combinations of fuels are coupled to the fuel delivery system for use with the burner 28. While the use of the three-way switching valve 32 is particularly convenient for quickly switching from one of the first and second fuels 20, 22 to the other fuel, it will be readily appreciated by those of skill in this particular art that other switchover structures could be alternatively utilized if desired. For example, instead of the three-way switching valve 32, two 2-way shutoff valves could be installed in the fuel supply lines 24 and 26.

Figure 3:
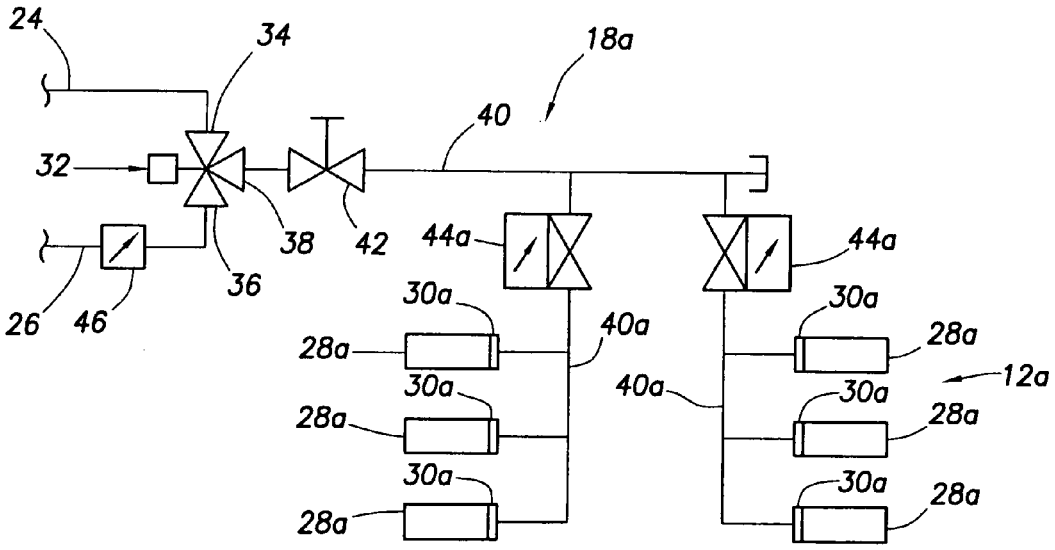
FIG. 3 is a schematic diagram of a multi-burner version of the FIG. 2 fuel delivery system.

FIG. 3 schematically illustrates modified burner apparatus 12*a* and an associated modified fuel supply system 18*a* which may be alternatively incorporated in the dual fuel boiler 10 or other fuel-fired heating appliance. Instead of the single burner 28 defining the burner apparatus 12 shown in FIG. 2, the modified burner apparatus 12*a* depicted in FIG. 3 comprises two pluralities of burners 28*a* (representatively two groups of three burners 28*a*). The modified fuel supply system 18*a* includes two branch fuel supply lines 40*a*, each of which couples the main fuel supply line 40 to one of the two burner groups as shown. The modified fuel supply system 18*a* also includes two pressure regulating apparatuses 44*a*, each of which is installed in one of the branch lines 40*a*. Representatively, each of the two pressure regulator apparatuses 44*a* has a setting equal to that of the single pressure regulator apparatus 44 shown in FIG. 2. In all other regards, the modified fuel supply system 18*a* is identical in construction and operation to the previously described fuel supply system 18 shown in FIG. 2. As in the case of the fuel supply system 18, the pressure regulator valves 44*a* are representatively set at 3.5" W.C., and the second fuel pressure regulator 46 is set at 2.0" W.C. Thus, by simply switching the valve 32 the multiple burners 28*a* may be operated at substantially equal firing rates using either of the two fuels 20 and 22 without the necessity of changing out any of the burner orifices 30*a*.

The foregoing detailed description is to be clearly understood as being given by way of illustration and example only, the spirit and scope of the present invention being limited solely by the appended claims.

What is claimed is:

1. A fuel-fired heating appliance comprising:

fuel burner apparatus having an inlet portion;

pressure regulator apparatus having an outlet portion coupled to said inlet portion of said fuel burner apparatus, and a predetermined pressure regulation setting; and fuel delivery apparatus coupled to said pressure regulator apparatus inlet portion and operative to deliver thereto a selectively variable one of (1) a first fuel, from a source thereof, at a pressure greater than said predetermined pressure regulation setting, and (2) a second fuel at a pressure lower than said predetermined pressure regulation setting, said pressure regulator apparatus regulating the pressure of fuel discharged from its outlet portion only with respect to said first fuel, said pressure regulator apparatus and said fuel delivery apparatus being coupled in a manner precluding said pressure regulation setting from being affected by which of said first and second fuels is being delivered to said pressure regulator apparatus.

2. A fuel-fired heating appliance comprising:

fuel burner apparatus having an inlet portion;

pressure regulator apparatus having an outlet portion coupled to said inlet portion of said fuel burner apparatus, and a predetermined pressure regulation setting; and fuel delivery apparatus coupled to said pressure regulator apparatus inlet portion and operative to deliver thereto a selectively variable one of (1) a first fuel, from a source thereof, at a pressure greater than said predetermined pressure regulation setting, and (2) a second fuel at a pressure lower than said predetermined pressure regulation setting, said fuel burner apparatus being of a non-aspirating type, and said fuel-fired heating appliance further comprising a blower operative to supply combustion air to said fuel burner apparatus.

3. The fuel-fired heating appliance of claim 1 wherein:

said fuel-fired heating appliance is a boiler.

4. The fuel-fired heating appliance of claim 1 wherein:

said first fuel is natural gas, and said second fuel is propane.

5. The fuel-fired heating appliance of claim 1 wherein said fuel delivery apparatus includes:

valve apparatus connected to said pressure regulator apparatus inlet portion, said valve apparatus being operative to receive the first and second fuels and permit the flow of a selectively variable one of them to said pressure regulator apparatus inlet portion.

6. The fuel-fired heating appliance of claim 5 wherein:

said valve apparatus includes a three-way valve operative to receive each of the first and second fuels.

7. The fuel-fired heating appliance of claim 5 wherein said fuel delivery apparatus further includes:

a pressure regulator operative to reduce the pressure of the second fuel when it is being flowed to said valve apparatus.

8. A fuel-fired heating appliance comprising:

fuel burner apparatus having an inlet portion;

pressure regulator apparatus having an outlet portion coupled to said inlet portion of said fuel burner apparatus, and a predetermined pressure regulation setting; and fuel delivery apparatus coupled to said pressure regulator apparatus inlet portion and operative to deliver thereto a selectively variable one of (1) a first fuel, from a source thereof, at a pressure greater than said predetermined pressure regulation setting, and (2) a second fuel at a pressure lower than said predetermined pressure regulation setting, said fuel burner apparatus comprising a plurality of fuel burners, and said pressure regulator apparatus comprising a plurality of pressure regulators operatively coupled to said plurality of fuel burners.

9. A fuel-fired heating appliance comprising:

a fuel burner having an inlet orifice; and a fuel supply system for alternately supplying first and second fuels having different Wobbe indexes to said inlet orifice at different pressures related to said different Wobbe indexes in a predetermined manner such that the firing rate of said fuel burner remains substantially the same, without changing said inlet orifice, regardless of which one of said first and second fuels is being supplied to said fuel burner, said fuel supply system including:

a first pressure regulator through which both of said first and second fuels must flow to reach said fuel burner, and a second pressure regulator through which only the higher Wobbe index fuel must flow to reach said fuel burner.

10. The fuel-fired heating appliance of claim 9 wherein:

said fuel-fired heating appliance is a fuel-fired boiler.

11. A fuel-fired heating appliance comprising:

a fuel burner having an inlet orifice; and a fuel supply system for alternately supplying first and second fuels having different Wobbe indexes to said inlet orifice at different pressures related to said different Wobbe indexes in a predetermined manner such that the firing rate of said fuel burner remains substantially the same, without changing said inlet orifice, regardless of which one of said first and second fuels is being supplied to said fuel burner, said fuel burner being a non-aspirating type burner; and said fuel-fired heating appliance further comprising a blower operative to supply combustion air to said fuel burner.

12. The fuel-fired heating appliance of claim 9 wherein:

the pressure regulation setting of said first pressure regulator is higher than the pressure regulation setting of said second pressure regulator.

13. A fuel-fired heating appliance comprising:

non-aspirating type fuel burner apparatus having an orificed fuel inlet portion;

blower apparatus for supplying combustion air to said fuel burner apparatus;

a main fuel supply line structure coupled to said orificed fuel inlet portion;

first pressure regulator apparatus connected in said main fuel line structure and having an inlet portion and a first pressure regulation setting;

a first branch fuel supply line structure, coupled to said inlet portion of said first pressure regulator apparatus, for receiving a pressurized first fuel;

a second branch fuel supply line structure, coupled to said inlet portion of said first pressure regulator apparatus, for receiving a pressurized second fuel having a Wobbe index higher than that of said first fuel;

valve apparatus operable to permit flow of only a selectively variable one of said first and second fuels to said inlet portion of said first pressure regulator apparatus and thus to said orificed fuel inlet portion of said fuel burner apparatus; and second pressure regulator apparatus connected in said second branch fuel supply line structure and having a second pressure regulation setting, said first and second pressure regulation settings being related to one another in a predetermined manner such that, without altering said orificed fuel inlet portion of said burner apparatus, the firing rate of said burner apparatus will remain essentially constant regardless of which of said first and second fuels is being supplied thereto.

14. The fuel-fired heating appliance of claim 13 wherein:

said fuel-fired heating appliance is a dual fuel boiler.

15. The fuel-fired heating appliance of claim 13 wherein:

said burner apparatus comprises a plurality of non-aspirating type fuel burners each having an orificed inlet.

16. The fuel-fired heating appliance of claim 13 wherein:

said first pressure regulation apparatus comprises a plurality of pressure regulator devices.

17. The fuel-fired heating appliance of claim 13 wherein:

said valve apparatus comprises a three-way switching valve to which each of said first and second branch fuel supply line structures is operatively coupled.

18. The fuel-fired heating appliance of claim 13 wherein:

said first pressure regulation setting is greater than said second pressure regulation setting.

19. A dual fuel method of supplying fuel to burner apparatus having an inlet portion, said method comprising the steps of:

providing pressure regulator apparatus having inlet and outlet portions and a predetermined pressure regulation setting;

operatively coupling said pressure regulator apparatus outlet portion to the burner apparatus inlet portion;

flowing to said pressure regulator apparatus inlet portion a selectively variable one of (1) a first fuel at a pressure greater than said predetermined pressure regulation setting, and (2) a second fuel at a pressure lower than said predetermined pressure regulation setting; and utilizing said pressure regulator apparatus to regulate the pressure of fuel discharged from its outlet portion only with respect to said first fuel.

20. The method of claim 19 wherein:

said flowing step is performed using a second fuel having a Wobbe index greater than that of said first fuel.

21. A method of operating a fuel-fired heating appliance, said method comprising the steps of:

providing the fuel-fired heating appliance with a fuel burner having an inlet orifice; and alternately supplying first and second fuels having different Wobbe indexes to said inlet orifice at different pressures related to said different Wobbe indexes in a predetermined manner such that the firing rate of said fuel burner remains substantially the same, without changing said inlet orifice, regardless of which one of said first and second fuels is being supplied to said fuel burner, said alternately supplying step being performed utilizing a first pressure regulator through which both of said first and second fuels must flow to reach said fuel burner, and a second pressure regulator through which only the higher Wobbe index fuel must flow to reach said fuel burner.

22. The method of claim 21 wherein:

said second fuel has a Wobbe index greater than that of said first fuel, and said alternately supplying step is performed in a manner supplying said first fuel to said inlet orifice at a higher pressure than the pressure at which said second fuel is supplied to said inlet orifice.

* * * * *